United States Patent [19]

Kuusisto

[11] 3,958,306

[45] May 25, 1976

[54] UMBRELLA FASTENER

[75] Inventor: Tarja Kuusisto, New York, N.Y.

[73] Assignee: Lawrence Peska Associates, Inc., New York, N.Y. ; a part interest

[22] Filed: Nov. 18, 1974

[21] Appl. No.: 524,542

[52] U.S. Cl. ..... 24/73 CS; 224/5 J

[51] Int. Cl.[2] ..... A44B 21/00; A45C 1/04

[58] Field of Search..... 24/81 AB, 255, 259 HC, 24/261 PT, 73 AS, 73 CS, 49 CF, 49 S, 3 C, 5, 11 C, 49 CC, 49 CP, 49 P; 43/25.2; 224/5 J; 135/37

[56] References Cited

UNITED STATES PATENTS

| | | | |
|---|---|---|---|
| 608,472 | 8/1898 | McCormack | 224/5 J |
| 686,090 | 11/1901 | Krekel | 24/81 AB X |
| 781,629 | 2/1905 | Ahlström | 24/73 CS UX |
| 1,021,978 | 4/1912 | Felch | 24/11 C |
| 1,707,591 | 4/1929 | Young | 24/49 CF |
| 3,067,537 | 12/1962 | Gregory et al. | 43/25.2 |

FOREIGN PATENTS OR APPLICATIONS

| | | | |
|---|---|---|---|
| 23,214 | 11/1894 | United Kingdom | 24/11 C |

*Primary Examiner*—Donald A. Griffin

[57] ABSTRACT

An umbrella fastener comprising: a tapered hollow truncated cylinder; and a holding means attached to one end of the cylinder for enabling a person to hold the cylinder.

3 Claims, 4 Drawing Figures

UMBRELLA FASTENER

This invention relates to an umbrella ring designed to keep an umbrella in a tightly closed position.

An object of this invention is to provide a simple, compact and easily operated umbrella ring, which serves to tightly contract the ribs of an umbrella together when set in place around the umbrella thereby securly keeping the umbrella closed.

Further objects will hereinafter appear.

The umbrella fastener is comprised of a tapered hollow truncated cylinder and a holding means attached to one end of the cylinder for enabling a person to hold the cylinder.

With the foregoing and other objects in view, this invention consists in the arrangement and combination of parts hereinafter described and claimed.

This invention is not to be restricted to the exact details of construction disclosed or suggested herein. For the purpose of illustrating a practical embodiment thereof reference is had to the accompanying drawings in which like reference characters designate the same parts in the several views, and in which.

Referring now more specifically to the drawings, 1 indicates the tapered hollow truncated cylinder. The tapered hollow truncated cylinder may be formed from a flat spirally wound band. The band may have spaces between the spirals. The cylinder may also be constructed of metal, plastic or any other type material suitable for forming in such shape.

The umbrella fastener is further comprised of a holding means 2 attached at one end to one end of the cylinder for enabling a person to hold the cylinder.

The holding means is preferably constructed of a flexible chain having a handle 4 attached at the other end of the flexible chain. The holding means is preferably connected at the narrow end of the cylinder.

Figure 1:
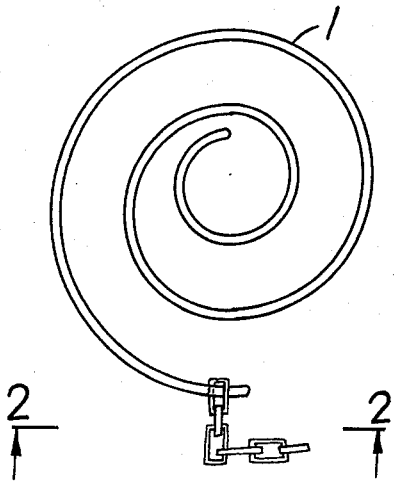
FIG. 1 is a plan view of an umbrella ring.
Figure 2:
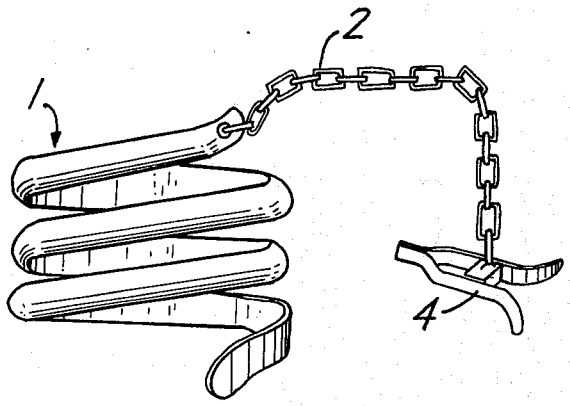
FIG. 2 is a perspective view of the umbrella ring and holding means.
Figure 3:
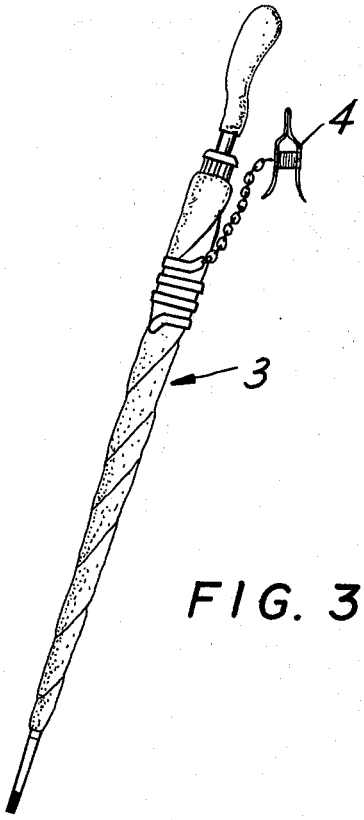
FIG. 3 is a plan view of the umbrella ring attached to an umbrella.
Figure 4:
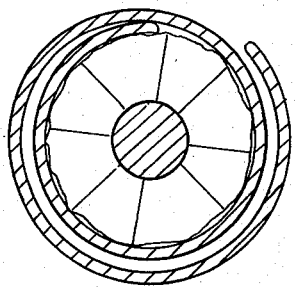
FIG. 4 is a sectional view taken along line 2—2 of FIG. 1.

A common fault of umbrellas is that the umbrella will not keep securly closed unless the cloth is rolled around the umbrella, due to the fact that usually the spring of the umbrella is so weak that the umbrella will be apt to open. By putting on the umbrella ring of this invention over the umbrella and pushing the umbrella ring up to the middle of the umbrella as shown in FIG. 3, the ribs are tightly contracted together. This enables the umbrella to remain securly closed and eliminates the necessity of rolling the cloth around the umbrella and also protects the ribs against breakage.

The umbrella ring with an umbrella in it may, for convenience, be held by hand, hung up by hook, etc.

The umbrella ring may be taken off the umbrella when it is desired to have the umbrella in an open position. The umbrella ring may be coveniently slipped in a pocket, pocketbook, etc.

It will, of course, be understood that certain details of the foregoing described structure may be varied without departing from the spirit of this invention.

Having herein described the invention, what is claimed as new is:

1. An umbrella fastener comprising:

a tapered hollow truncated cylinder formed of a flat spirally wound band of a diameter and taper substantially equivalent to a diameter and taper of an umbrella, whereby when the umbrella fastener is set in place around the umbrella and moved toward an end of the umbrella the ribs of the umbrella and the cloth of the umbrella are tightly and evenly contracted together and the umbrella kept securely and neatly closed;

a flexible chain attached to one end of the cylinder; and a handle attached to the other end of the flexible chain, thereby enabling a person to hold the umbrella in a pendant type manner.

2. The umbrella fastener of claim 1, wherein the flat spirally wound band is constructed of metal.

3. The umbrella fastener of claim 1, wherein the flat spirally wound band is constructed of plastic.

* * * * *